US011239562B2

(12) United States Patent
Jia

(10) Patent No.: US 11,239,562 B2
(45) Date of Patent: Feb. 1, 2022

(54) ANTENNA MODULE AND ELECTRONIC DEVICE

(71) Applicant: GUANGDONG OPPO MOBILE TELECOMMUNICATIONS CORP., LTD., Guangdong (CN)

(72) Inventor: Yuhu Jia, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 57 days.

(21) Appl. No.: 16/816,884

(22) Filed: Mar. 12, 2020

(65) Prior Publication Data

US 2020/0313299 A1 Oct. 1, 2020

(30) Foreign Application Priority Data

Mar. 28, 2019 (CN) ..... 201910243151.2

(51) Int. Cl.
*H01Q 1/38* (2006.01)
*H01Q 9/04* (2006.01)
(Continued)

(52) U.S. Cl.
CPC ..... *H01Q 9/0414* (2013.01); *H01Q 1/48* (2013.01); *H01Q 5/307* (2015.01); *H01Q 9/045* (2013.01); *H01Q 13/10* (2013.01)

(58) Field of Classification Search
CPC ..... H01Q 9/0414; H01Q 5/307; H01Q 1/48; H01Q 9/045; H01Q 13/10
See application file for complete search history.

(56) References Cited

U.S. PATENT DOCUMENTS 5,043,738 A 8/1991 Shapiro et al.
9,379,434 B2 6/2016 Sato et al.
(Continued)

FOREIGN PATENT DOCUMENTS

CN 101064381 A 10/2007
CN 104685578 A 6/2015
(Continued)

OTHER PUBLICATIONS

Sethi, "Design of Dual Polarized Hybrid LTCC Antenna for UWB RFID Applications", IEEE, 4 pages, 2016 (Year: 2016).*
(Continued)

*Primary Examiner* — Dieu Hien T Duong
(74) *Attorney, Agent, or Firm* — Young Basile Hanlon & MacFarlane, P.C.

(57) ABSTRACT

The present disclosure relates to an antenna module and an electronic device. The antenna module includes: a feeding layer; a ground layer arranged on the feeding layer and provided with a first slot and a second slot, the first slot and the second slot being separated and having orthogonal polarization directions; a dielectric base plate arranged on the ground layer; and a stacked patch antenna including a first radiation patch and a second radiation patch. The first radiation patch and the second radiation patch are arranged on two sides of the dielectric base plate facing away from each other, respectively, and the first radiation patch is aligned with the second radiation patch. The feeding layer is configured to feed the stacked patch antenna through the first slot and the second slot.

20 Claims, 12 Drawing Sheets

(51) Int. Cl.

| | |
|---|---|
| ***H01Q 5/307*** | (2015.01) |
| ***H01Q 1/48*** | (2006.01) |
| ***H01Q 13/10*** | (2006.01) |

(56) References Cited

U.S. PATENT DOCUMENTS

| | | | | |
|---|---|---|---|---|
| 2014/0253400 | A1 | 9/2014 | Tiezzi et al. | |
| 2016/0064832 | A1 | 3/2016 | Shin et al. | |
| 2016/0094091 | A1 | 3/2016 | Shin et al. | |
| 2016/0344089 | A1* | 11/2016 | Baik | G04G 21/08 |
| 2020/0021010 | A1* | 1/2020 | Ou | H01Q 1/243 |

FOREIGN PATENT DOCUMENTS

| | | | |
|---|---|---|---|
| CN | 105305037 | A | 2/2016 |
| CN | 105474462 | A | 4/2016 |
| CN | 105609937 | A | 5/2016 |
| CN | 205488479 | U | 8/2016 |
| CN | 206602180 | U | 10/2017 |
| CN | 107591608 | A | 1/2018 |
| CN | 207165756 | U | 3/2018 |
| CN | 108461929 | A | 8/2018 |
| CN | 108539395 | A | 9/2018 |
| CN | 109066075 | A | 12/2018 |
| CN | 109088180 | A | 12/2018 |
| CN | 109103589 | A | 12/2018 |
| CN | 109119768 | A | 1/2019 |
| CN | 109149069 | A | 1/2019 |
| CN | 110048224 | A | 7/2019 |
| JP | 02079602 | A * | 3/1990 |

OTHER PUBLICATIONS

Kumar, "Effect of Slots in Ground Plane and Patch on Microstrip Antenna Performance", International Journal of Recent Trends in Engineering, vol. 2, No. 6, Nov. 2009, pp. 34-36 (Year: 2009).*

English translation of First OA for CN application 201910243151.2 dated Mar. 25, 2020.

International Search Report for PCT application PCT/CN2020/080014 dated May 28, 2020.

OA for EP application 20165015.7 dated Sep. 21, 2020.

Chinese Notice of Allowance with English Translation for CN Application 201910243151.2 dated Mar. 23, 2021. (12 pages).

Indian Examination Report for IN Application 202014011971 dated Mar. 31, 2021. (6 pages).

* cited by examiner

ANTENNA MODULE AND ELECTRONIC DEVICE

CROSS-REFERENCE TO RELATED APPLICATION(S)

This application claims priority to and benefit of Chinese Patent Application Serial No. 201910243151.2, filed on Mar. 28, 2019, the entire content of which is incorporated by reference.

TECHNICAL FIELD

The present disclosure relates to a field of antenna technology, and more particularly to an antenna module and an electronic device.

BACKGROUND

With the development of wireless communication technology, 5G network technology is born. As the fifth generation of mobile communication network, a peak theoretical transmission speed of 5G network may be up to tens of Gb per second, which is hundreds times as fast as that of 4G network. Therefore, a millimeter wave band with enough spectrum resources has become one of working frequency bands of a 5G communication system.

A metal middle frame in conjunction with a 3D glass rear cover, or a metal middle frame in conjunction with a ceramic rear cover, or a full 3D glass, or a full ceramic is a mainstream solution in a structural design of a future full-screen mobile phone, which can provide better protection, aesthetics, heat dissipation, color and user experiences. However, due to high dielectric constants of a 3D glass rear cover and a ceramic rear cover, a radiation performance of a millimeter wave antenna will be seriously affected, and a gain of an antenna array will be reduced.

SUMMARY

Embodiments of the present disclosure provide an antenna module and an electronic device.

The antenna module according to a first aspect of embodiments of the present disclosure includes: a feeding layer; a ground layer arranged on the feeding layer, and provided with a first slot and a second slot, the first slot and the second slot being separated and having orthogonal polarization directions; a dielectric base plate arranged on the ground layer; a stacked patch antenna including a first radiation patch and a second radiation patch. The first radiation patch and the second radiation patch are arranged on two sides of the dielectric base plate facing away from each other, and the first radiation patch is aligned with the second radiation patch. An orthogonal projection of the first radiation patch on the ground layer covers at least one of at least part of the first slot and at least part of the second slot, and an orthogonal projection of the second radiation patch on the ground layer covers at least one of at least part of the first slot and at least part of the second slot. The feeding layer is configured to feed the stacked patch antenna through the first slot and the second slot, the first radiation patch is configured to generate a resonance in a first frequency band under the feeding of the feeding layer, and the second radiation patch is configured to generate a resonance in a second frequency band under the feeding of the feeding layer.

The electronic device according to a second aspect of embodiments of the present disclosure includes: a feeding layer; a ground layer arranged on the feeding layer and provided with a first slot and a second slot, the first slot and the second slot being separated and having orthogonal polarization directions; a non-metallic rear cover arranged opposite to the ground layer; and a stacked patch antenna comprising a first radiation patch and a second radiation. The first radiation patch and the second radiation patch are arranged on the rear cover and face away from each other. An orthogonal projection of the first radiation patch on the ground layer covers at least one of at least part of the first slot and at least part of the second slot, and an orthogonal projection of the second radiation patch on the ground layer covers at least one of at least part of the first slot and at least part of the second slot. The feeding layer is configured to feed the stacked patch antenna through the first slot and the second slot, the first radiation patch is configured to generate a resonance in a first frequency band under the feeding of the feeding layer, and the second radiation patch is configured to generate a resonance in a second frequency band under the feeding of the feeding layer.

The electronic device according to a third aspect of embodiments of the present disclosure includes a rear cover, a ground layer, a stacked patch antenna and a feeding layer. The rear cover has a first surface and a second surface facing away from each other, and is made of non-metallic materials. The ground layer is arranged opposite to the first surface of the rear cover, and has a first slot and a second slot separated from each other. The first slot has a polarization direction orthogonal to a polarization direction of the second slot. The stacked patch antenna includes a first radiation patch and a second radiation. The first radiation patch and the second radiation patch are arranged to the first surface and the second surface of the rear cover, respectively. An orthogonal projection of the first radiation patch on the ground layer covers at least one of at least part of the first slot and at least part of the second slot, and an orthogonal projection of the second radiation patch on the ground layer covers at least one of at least part of the first slot and at least part of the second slot. The feeding layer is arranged to a side of the ground layer facing away from the rear cover, and configured to feed the stacked patch antenna through the first slot and the second slot. The first radiation patch is configured to generate a resonance in a first frequency band under the feeding of the feeding layer, and the second radiation patch is configured to generate a resonance in a second frequency band under the feeding of the feeding layer.

BRIEF DESCRIPTION OF DRAWINGS

In order to more clearly explain technical solutions in embodiments of the present disclosure or in the related art, the drawings needed to be used in descriptions of the embodiments or the related art will be introduced briefly. Obviously, the drawings in the following descriptions are merely some embodiments of the present disclosure. For those ordinary skilled in the related art, other drawings may be obtained according to theses drawings without creative labors.

DETAILED DESCRIPTION

In order to make the purpose, technical solution and advantages of the present disclosure clearer, the present disclosure will be further described in detail below with reference to the accompanying drawings and embodiments. It should be understood that the embodiments described herein are merely used to explain the present disclosure, and cannot be construed as a limitation to the present disclosure.

It should be understood that, although terms such as "first" and "second" are used herein for describing various elements, these elements should not be limited by these terms. These terms are only used for distinguishing one element from another element, and are not intended to indicate or imply relative importance or significance or to imply the number of indicated technical features. Thus, the feature defined with "first" and "second" may explicitly or implicitly include one or more of this feature. In the description of the present disclosure, "a plurality of" means two or more than two, such as two and three, unless specified otherwise.

It should be noted that when an element is called to be arranged to another element, it may be directly arranged on another component or there may be an intermediate element. When an element is considered to be connected to another element, it may be directly connected to another component or there may be an intermediate element.

An antenna module according to an embodiment of the present disclosure is applied to an electronic device. In an embodiment, the electronic device may include a mobile phone, a tablet computer, a notebook computer, a palmtop computer, a mobile Internet device (MID), a wearable device (such as a smart watch, a smart bracelet, a pedometer, and so on) or other communication modules provided with an array antenna module.

Figure 1:
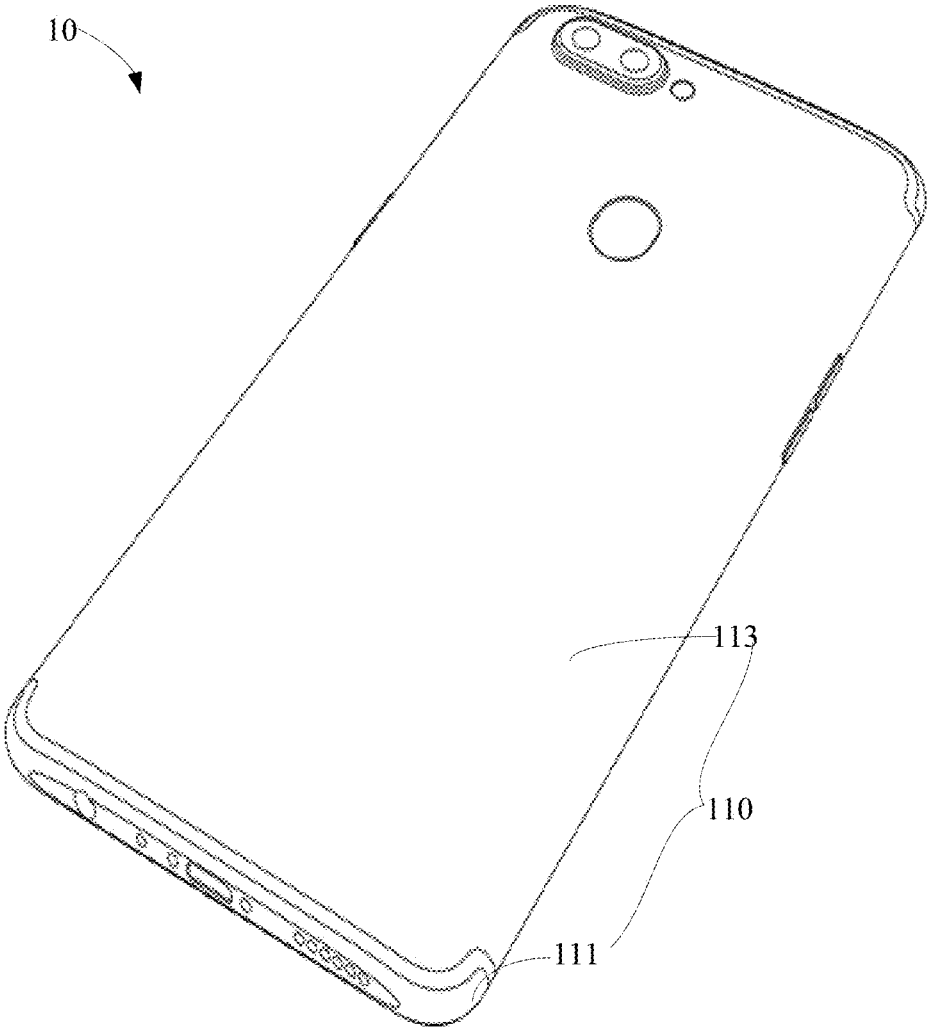
FIG. 1 is a perspective view of an electronic device in an embodiment.

As illustrated in FIG. 1, in the embodiment of the present disclosure, the electronic device 10 may include a housing assembly 110, a substrate, a display assembly, and a controller. The display assembly is fixed to the housing assembly 110 and forms an external structure of the electronic device together with the housing assembly 110. The housing assembly 110 may include a middle frame 111 and a rear cover 113. The middle frame 111 may be a frame structure having a through hole. The middle frame 111 may be accommodated in an accommodating space formed by the display assembly and the rear cover 113. The rear cover 113 is used to form an external profile of the electronic device. The rear cover 113 may be formed integrally. In a molding process of the rear cover 113, a rear camera hole, a fingerprint identification module, an antenna module mounting hole and other structures may be formed in the rear cover 113. The rear cover 113 may be a non-metallic rear cover 113. For example, the rear cover 113 may be a plastic rear cover 113, a ceramic rear cover 113, a 3D glass rear cover 113, and so on. The substrate is fixed inside the housing assembly, and may be a printed circuit board (PCB) or a flexible printed circuit board (FPCB). An antenna module for receiving and transmitting millimeter wave signals and a controller configured to control an operation of the electronic device may be integrated on the rear cover 113. The display component may be used to display pictures or texts, and may provide a user with an operation interface.

In an embodiment, the housing assembly 110 is integrated with an antenna module 20. A beam of the antenna module 20 points to an outside of the rear cover 113 and millimeter wave signals may be transmitted and received through the rear cover 113, such that the electronic device may achieve a wide coverage of the millimeter wave signals.

Figure 2:
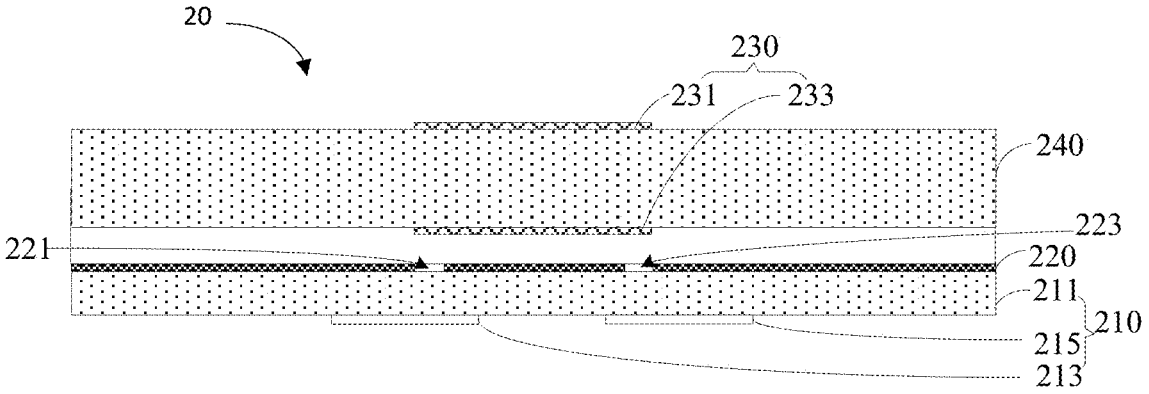
FIG. 2 is a sectional view of an antenna module in an embodiment.

As illustrated in FIG. 2, an embodiment of the present disclosure provides an antenna module 20, which includes a feeding layer 210, a ground layer 220 provided with a first slot 221 and a second slot 223 which are separated and whose polarization directions are orthogonal, a stacked patch antenna 230 provided with a first radiation patch 231 and a second radiation patch 233, and a dielectric base plate 240.

In an embodiment, the feeding layer 210 includes a feeding substrate 211, as well as a first feeding unit 213 and a second feeding unit 215 arranged on the feeding substrate 211. The first feeding unit 213 and the second feeding unit 215 have different feeding polarization directions. The feeding substrate 211 includes a first surface and a second surface facing away from each other. It should be noted that the first surface is a surface facing away from the ground layer 220, and the second surface is a surface facing towards the ground layer 220. The first feeding unit 213 and the second feeding unit 215 are both arranged to the first surface.

In an embodiment, the first feeding unit 213 and the second feeding unit 215 both include a feeding route. The first feeding unit 213 may be understood as a vertical polarization feeding route, and the second feeding unit 215 may be understood as a horizontal polarization feeding route. In some embodiments, the first feeding unit 213 may also be understood as a horizontal polarization feeding route, and the second feeding unit 215 may be understood as a vertical polarization feeding route.

A routing direction of the feeding unit is an extending direction of the feeding route. In some embodiments, the feeding route is strip line, whose impedance is easy to control and whose shielding is good, thus effectively reducing a loss of electromagnetic energy and improving the efficiency of the antenna.

The ground layer 220 is located on a side of the feeding substrate 211 far away from the first feeding unit 213 or the second feeding unit 215. That is, the ground layer 220 is located on the second surface of the feeding substrate 211. The ground layer 220 is provided with the first slot 221 and the second slot 223, the first slot 221 and the second slot 223 are separated, and the polarization direction of the first slot 221 is orthogonal to the polarization direction of the second slot 223.

In some embodiments, the first slot 221 is separated from the second slot 223. The first slot 221 is arranged corresponding to the first feeding unit 213, and the second slot 223 is arranged corresponding to the second feeding unit 215. In some embodiments, an orthogonal projection area of the first feeding unit 213 on the ground layer 220 may completely cover an area where the first slot 221 is, and an orthogonal projection area of the second feeding unit 215 on the ground layer 220 may completely cover an area where the second slot 223 is.

An extending direction of the first slot 221 is vertical to an extending direction of the second slot 223. That is, the polarization direction of the first slot 221 is perpendicular to the polarization direction of the second slot 223. For example, when the first slot 221 is a vertical polarization slot, the second slot 223 is a horizontal polarization slot, or when the first slot 221 is a horizontal polarization slot, the second slot 223 is a vertical polarization slot.

It should be noted that the extending direction of each of the first slot 221 and the second slot 223 may be understood as a direction along a long edge of the slot, and the polarization direction of each of the first slot 221 and the second slot 223 may be understood as a direction along a narrow edge of the slot.

In an embodiment, the extending direction of the first slot 221 is perpendicular to the routing direction of the first feeding unit 213, and the extending direction of the second slot 223 is perpendicular to the routing direction of the second feeding unit 215. That is, the polarization direction of the first slot 221 is the same with the polarization direction of the first feeding unit 213, and the polarization direction of the second slot 223 is the same with the polarization direction of the second feeding unit 215. For example, when the first slot 221 is the vertical polarization slot, the first feeding unit 213 is the vertical polarization feeding route, the second slot 223 is the horizontal polarization slot, and the first feeding unit 213 is the horizontal polarization feeding route.

The stacked patch antenna 230 includes the first radiation patch 231 and the second radiation patch 233 both arranged corresponding to the first slot 221 and the second slot 223. The first radiation patch 231 and the second radiation patch 233 are located on two sides of the dielectric base plate 240 facing away from each other, respectively, and the first radiation patch 231 is orthogonally projected on the second radiation patch 233, that is, the first radiation patch 231 is aligned with the second radiation patch 233. In some embodiments, an orthogonal projection of the first radiation patch 231 on the ground layer 220 may cover at least part of the first slot 221 and/or at least part of the second slot 223, and an orthogonal projection of the second radiation patch 233 on the ground layer 220 may cover at least part of the first slot 221 and/or at least part of the second slot 223.

The dielectric base plate 240 may be made of materials with a high dielectric constant, such as plastic, ceramic, 3D glass, and so on. The dielectric base plate 240 includes an outer surface and an inner surface facing away from each other. The outer surface is a surface facing away from the ground layer 220, and the inner surface is a surface facing towards the ground layer 220. The first radiation patch 241 is attached to the outer surface of the dielectric base plate 240, and the second radiation patch is attached to the inner surface of the dielectric base plate 240. Moreover, the first radiation patch 231 may be completely orthogonally projected on an area where the second radiation patch 233 is. In an embodiment, geometric centers of the first radiation patch 231 and the second radiation patch 233 are both located in an axis perpendicular to a plane where the rear cover 113 is. That is, the geometric centers of the first radiation patch 231 and the second radiation patch 233 are symmetrically arranged with respect to the plane where the rear cover 113 is.

In an embodiment, the materials of the first radiation patch 231 and the second radiation patch 233 may be metal materials, transparent conductive materials with a high conductivity (such as indium tin oxide, silver nanowire, ITO materials, graphene, and so on).

The feeding layer 210 feeds the stacked patch antenna 230 through the first slot 221 and the second slot 223, such that the first radiation patch 231 generates a resonance in a first frequency band and the second radiation patch 233 generates a resonance in a second frequency band. With the first slot 221 and the second slot 223, a coupling with the stacked patch antenna 230 may be realized so as to generate a resonance in a preset frequency band. Thus, the first radiation patch 231 generates the resonance in the first frequency band and the second radiation patch 233 generates the resonance in the second frequency band, so as to realize a full-frequency-band coverage of the antenna module.

Sizes of the first slot 221 and the second slot 223 in the ground layer 220 are adjusted to couple with the stacked patch antenna 230 (the first radiation patch 231 and the second radiation patch 233) so as to generate a resonance in a third frequency band. In an embodiment, for example, the size (such as a length, a width, a distance between the slot and the stacked patch antenna 230) of the slot may be changed. When the lengths of the first slot 221 and the second slot 223 are set to ½ of a dielectric wavelength, the coupling between the first slot 221, the second slot 223 and the stacked patch antenna 230 (the first radiation patch 231 and the second radiation patch 233) can generate a resonance in the vicinity of a frequency band of 25 GHz-26 GHz. The first slot 221 and the second slot 223 can conduct a coupled feeding with the first radiation patch 231 to allow the first radiation patch 231 to generate a resonance of 28 GHz, and can conduct a coupled feeding with the second radiation patch 233 to allow the second radiation patch 2333 to generate a resonance of 39 GHz, so as to realize the dual frequency coverage of the antenna module.

According to rules of 3GPP 38. 101 Agreement, 5G NR mainly uses two frequency bands: FR1 frequency band and FR2 frequency band. The frequency range of FR1 frequency band is 450 MHz-6 GHz, which is usually called sub 6 GHz. The frequency range of FR2 frequency band is 4.25 GHz-52.6 GHz, which is usually called millimeter wave (mm Wave). The 3GPP specifies frequency bands of the 5G millimeter wave as follows: n257 (26.5-29.5 GHz), n258 (24.25-27.5 GHz), n261 (27.5-28.35 GHz) and n260 (37-40 GHz).

In the above antenna module, the ground layer 220 is provided with the first slot 221 and the second slot 223, which are separated and have orthogonal polarization directions, and the stacked patch antenna 230 (the first radiation patch 231 and the second radiation patch 233) is fed by coupling of the feeding layer 210 at a bottom layer through the first slot 221 and the second slot 223, such that the first radiation patch 231 generates the resonance in the first frequency band (such as a resonance in a 28 GHz frequency band) and the second radiation patch 233 generates the resonance in the second frequency band (such as a resonance of 39 GHz frequency band). The sizes of the first slot 221 and the second slot 223 are adjusted to couple with the stacked patch antenna 230 so as to generate the resonance in the third band (such as, 25 GHz). Therefore, the antenna can realize requirements of a full frequency band (for example, a coverage of n257, n258 and n261 frequency bands may be realized) and a dual polarization of 5G millimeter wave.

As illustrated in FIG. 2, in an embodiment, the first radiation patch 231 is attached to the side of the dielectric base plate (i.e. an antenna base plate) 240 facing away from the ground layer 220, and the second radiation patch 233 is attached to the side of the antenna base plate 240 facing towards the ground layer 220. In some embodiments, the antenna base plate 240 includes a third surface and a fourth surface facing away from each other. The first radiation patch 231 is attached to the third surface of the antenna base plate 240, and the second radiation patch 233 is attached to the fourth surface of the antenna base plate 240. The geometric centers of the first radiation patch 231 and the second radiation patch 233 are symmetrically arranged with respect to a plane where the antenna base plate 240 is.

In an embodiment, the first radiation patch 231 is a loop patch antenna, such as a square loop patch or a round loop patch. The second radiation patch 233 is one of a square patch, a round patch, a loop patch and a cross patch. In the present embodiment, when the first radiation patch 231 is the loop patch antenna, the effective radiance of the second radiation patch 233 may be increased.

Figure 3A:
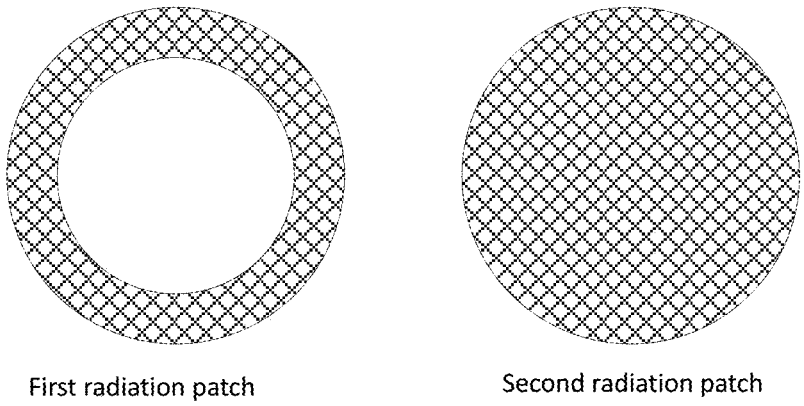
FIG. 3 is a view illustrating a position relationship between a rear cover and a radiation patch in an embodiment.
Figure 3B:
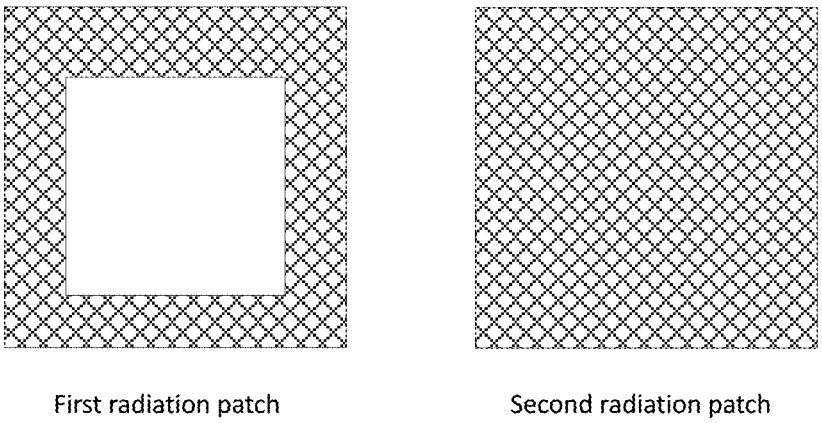

In an embodiment, when the first radiation patch 241 is the loop patch antenna, an outline of the first radiation patch 241 is the same with an outline of the second radiation patch 233. For example, as illustrated in FIG. 3*a*, the first radiation patch 241 is the round loop patch, and the second radiation patch 233 is the round patch; or, as illustrated in FIG. 3*b*, the first radiation patch 241 is the square loop patch, and the second radiation patch 233 is the square patch, and so on.

Figure 4A:
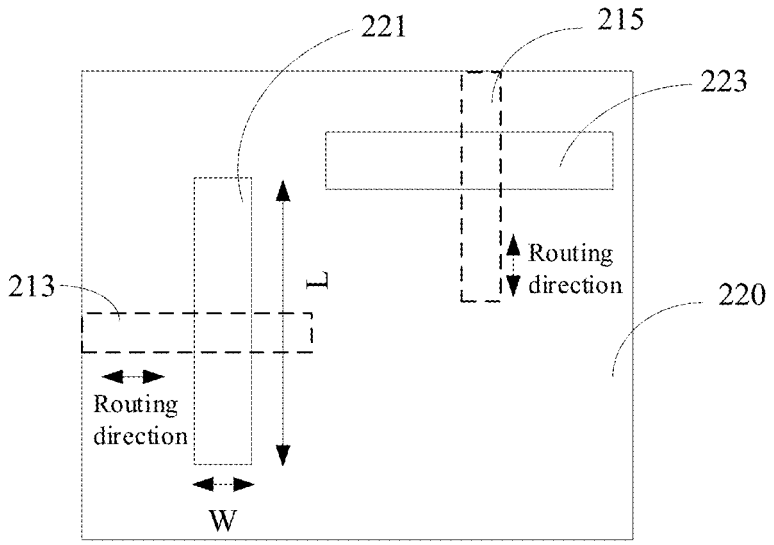
FIGS. 4A-4B are schematic views of two slots and two feeding units in different embodiments.

As illustrated in FIG. 4A, in an embodiment, both the first slot 221 and the second slot 223 are rectangular slots, and the extending direction of the first slot 221 is arranged perpendicular to the extending direction of the second slot 223. The extending direction may be understood as a direction (L) along a long edge of the rectangular slot, and the polarization direction of each of the first slot 221 and the second slot 223 may be understood as a direction (W) along a narrow edge of the rectangular slot. The routing direction of the first feeding unit 213 is perpendicular to the extending direction of the first slot 221, and the routing direction of the second feeding unit 215 is perpendicular to the extending direction of the second slot 223.

In an embodiment, at least part of the first slot 221 is orthogonally projected on an area of the first radiation patch 231 or an area of the second radiation patch 233, and at least part of the second slot 223 is orthogonally projected on the area of the first radiation patch 231 or the area of the second radiation patch 233.

The first radiation patch 231 and the second radiation patch 233 are both coupled and fed through the first slot 221 and the second slot 223, such that the first slot 221 and the second slot 223 couple with the first radiation patch 231 so as to generate the resonance of 28 GHz and couple with the second radiation patch 233 so as to generate the resonance of 39 GHz, thereby realizing the requirements of the dual frequency coverage and the dual polarization of the antenna module.

Figure 4B:
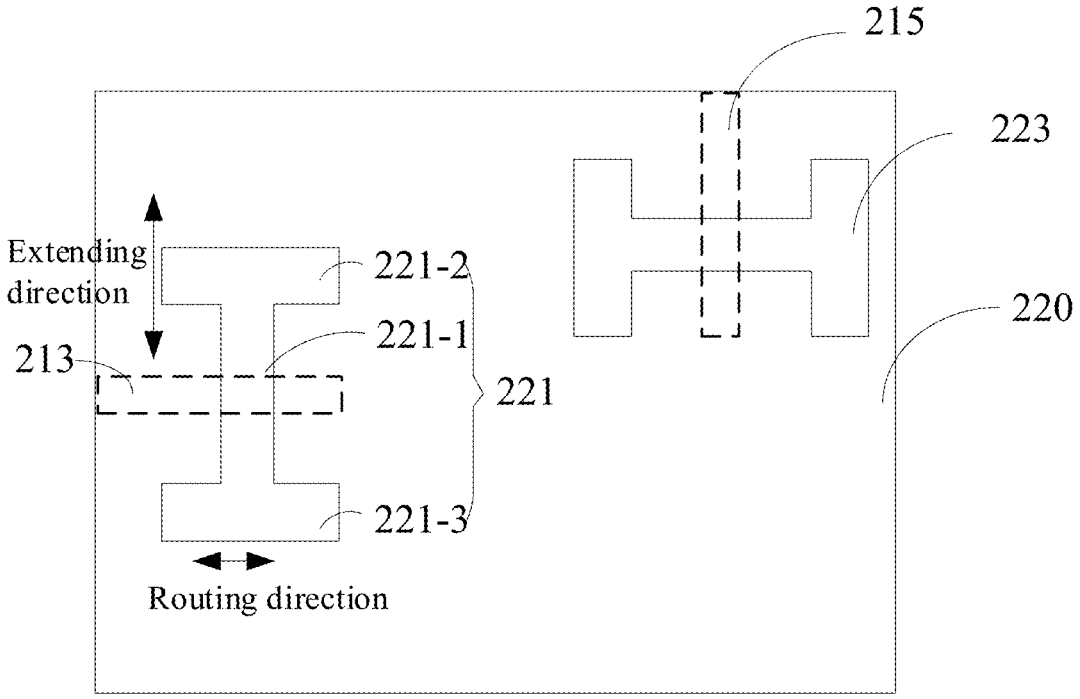

As illustrated in FIG. 4B, in an embodiment, the first slot 221 has the same shape as the second slot 223. Taking the first slot 221 as an example, the first slot 221 includes a first part 221-1, a second part 221-2 and a third part 221-3, and the second part 221-2 and the third part 221-3 are communicated with the first part 221-1, respectively. The second part 221-2 and the third part 221-3 are arranged in parallel, and the first part 221-1 is arranged perpendicular to the second part 221-2 and the third part 221-3, respectively. All the first part 221-1, the second part 221-2 and the third part 221-3 are linear slots 221. That is, the first slot 221 and the second slot 223 are both "H"-shaped slots.

The extending directions of the first slot 221 and the second slot 223 may be understood as an extending direction of the first part 221-1, that is, a direction perpendicular to the second part 221-2 or the third part 221-3. Moreover, the routing directions of the first feeding unit 213 and the second feeding unit 215 are both arranged perpendicular to the first part 221-1 of the "H"-shaped slot.

In an embodiment, at least part of the first slot 221 is orthogonally projected on the area of the first radiation patch 231 or the area of the second radiation patch 233, and at least part of the second slot 223 is orthogonally projected on the area of the first radiation patch 231 or the area of the second radiation patch 233.

In the present embodiment, by providing the first slot 221 and the second slot 223 whose polarization directions are arranged orthogonally and by respective couplings of the first feeding unit 213 and the second feeding unit 215 at the bottom layer through the first slot 221 and the second slot 223, the stacked patch antenna 230 (the first radiation patch 231 and the second radiation patch 233) is fed, such that the first radiation patch 231 generates the resonance in the 28 GHz frequency band and the second radiation patch 233 generates the resonance in a 39 GHz frequency band. Furthermore, the sizes of the first slot 221 and the second slot 223 are adjusted to couple with the stacked patch antenna 230 (the first radiation patch 231 and the second radiation patch 233) so as to generate another resonance in the vicinity of 25 GHz frequency band, and thus the antenna can achieve the requirements of 3GPP full frequency band and dual polarization.

Figure 5:
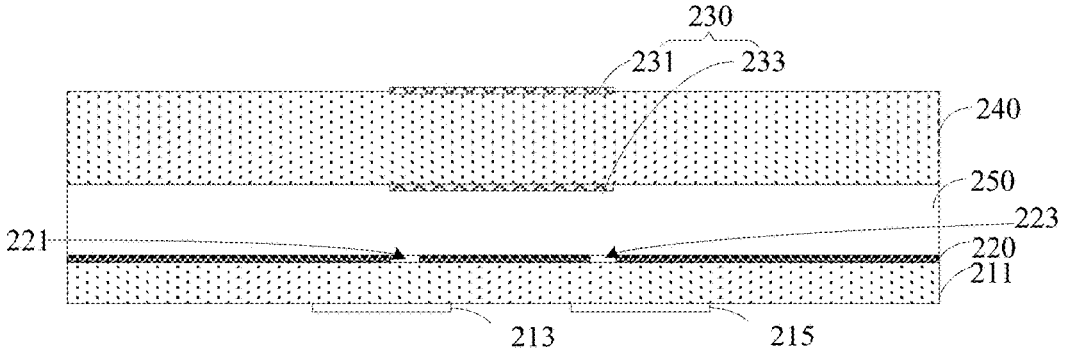
FIG. 5 is a sectional view of an antenna module in another embodiment.

As illustrated in FIG. 5, in an embodiment, the antenna module further includes a support layer 250 arranged between the dielectric base plate 240 and the ground layer 220. The support layer 250 may be a foam layer, an air layer, an adhesive layer or other stacked structures formed by low-dielectric-constant support materials, so as to prevent the second radiation patch 233 from falling.

In some embodiments, a dielectric constant of the support layer 250 is less than a dielectric constant of the dielectric base plate 240.

Figure 6:
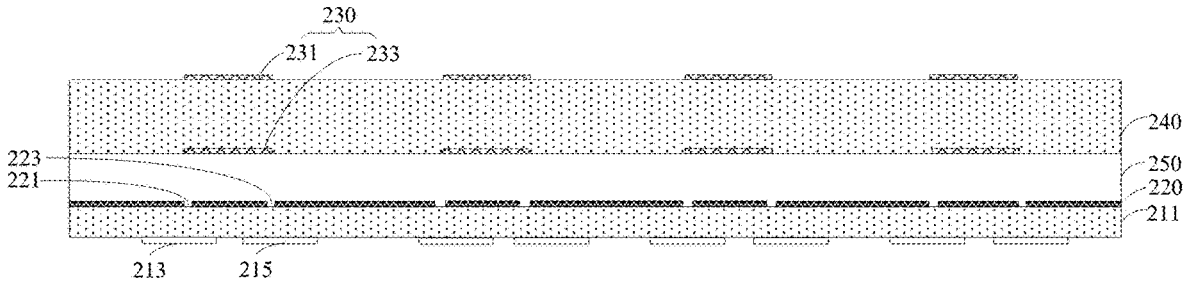
FIG. 6 is a sectional view of an antenna module in still another embodiment.

As illustrated in FIG. 6, in an embodiment, a plurality of the first radiation patches 231 and a plurality of the second radiation patches 233 are provided, and the number of the first radiation patches 231 is the same with the number of the second radiation patches 233. That is, the first radiation patch 231 and the second radiation patch 233 are arranged in pairs. Moreover, the numbers of the first slots 221 and the second slots 223 provided in the ground layer 220 matches with the number of the first radiation patches 231. For example, the numbers of the first slots 221 and the second slots 223 may be equal to the number of the first radiation patches 231.

For example, the number of the first radiation patches 231 and the number of the second radiation patches 233 may be set to four. That is, four first radiation patches 231 may form a first antenna array and four second radiation patches 233 may form a second antenna array. In some embodiments, both the first antenna array and the second antenna array are one-dimensional linear arrays. For example, the first antenna array is a 1*4 linear array, and the second antenna array is also a 1*4 linear array.

In the present embodiment, both the first antenna array and the second antenna array are one-dimensional linear arrays, so as to reduce an occupied space of the antenna module. Further, only one angle needs to be scanned, thereby simplifying a design difficulty, a test difficulty and a complexity of a wave beam management.

Figure 7:
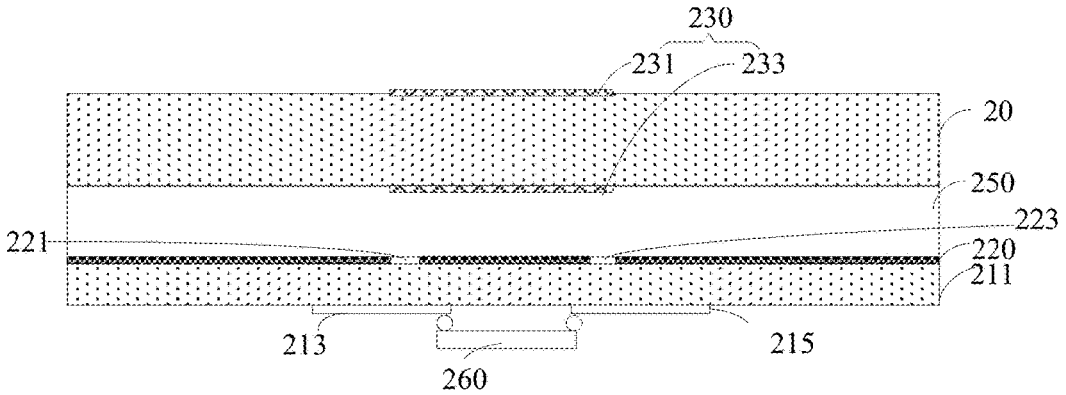
FIG. 7 is a sectional view of an antenna module in yet another embodiment.

As illustrated in FIG. 7, in an embodiment, the antenna module further includes a dual radio frequency integrated circuit 260, and the dual radio frequency integrated circuit 260 is encapsulated to a side of the feeding substrate 211 facing away from the ground layer 220. A feeding port of the dual radio frequency integrated circuit 260 is connected with the feeding unit so as to interconnect with the stacked patch antenna 230.

Figure 8:
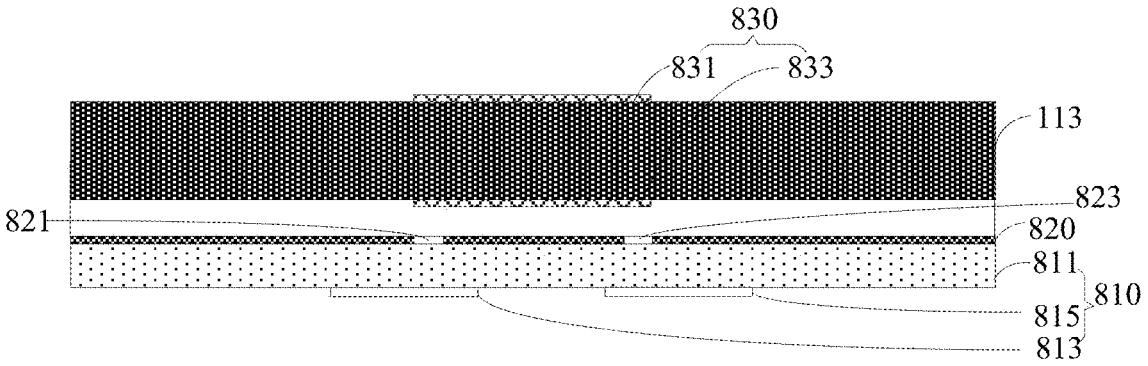
FIG. 8 is a sectional view of an electronic device in an embodiment.

As illustrated in FIG. 8, the embodiment of the present disclosure also provides an electronic device. In an embodiment, the electronic device includes: a feeding layer 810; a ground layer 820 arranged on the feeding layer 810, and provided with a first slot 821 and a second slot 823 which are separated and have orthogonal polarization directions; a non-metallic rear cover 113 arranged corresponding to the ground layer 880; and a stacked patch antenna 830 including a first radiation patch 831 and a second radiation patch 833 both arranged corresponding to the first slot 821 and the second slot. The first radiation patch 831 and the second radiation patch 833 face away from each other and located in different areas of the rear cover 113.

The feeding layer 810 feeds the stacked patch antenna 830 through the first slot 821 and the second slot 823, such that the first radiation patch 831 generates a resonance in a first frequency band and the second radiation patch 833 generates a resonance in a second frequency band.

The feeding layer 810 feeds the stacked patch antenna 830 through the first slot 821 and the second slot 823, such that the first radiation patch 831 generates the resonance in the first frequency band and the second radiation patch 833 generates the resonance in the second frequency band. The coupling with the stacked patch antenna 830 can be realized through the first slot 821 and the second slot 823 so as to generate a resonance in a preset frequency band, such that the first radiation patch 831 generates the resonance in the first frequency band and the second radiation patch 833 generates the resonance in the second frequency band, so as to realize the full frequency band coverage of the antenna module.

In some embodiments, the non-metallic rear cover 113 is arranged opposite to and parallel with the ground layer 880.

In an embodiment, sizes of the first slot 821 and the second slot 823 provided in the ground layer 880 may be adjusted to couple with the stacked patch antenna 830 (the first radiation patch 831 and the second radiation patch 833), so as to generate a resonance in a third frequency band. In some embodiments, the size (such as a length, a width, a distance between the slot and the stacked patch antenna 830) of the slot may be changed. When the length of the first slot 821 and the second slot 823 is set to ⅛ of a dielectric wavelength, the coupling between the first slot 821, the second slot 823 and the stacked patch antenna 830 (the first radiation patch 831 and the second radiation patch 833) can generate a resonance in the vicinity of a 25 GHz-26 GHz frequency band. The first slot 821 and the second slot 823 can conduct the coupled feeding with the first radiation patch 231 to allow the first radiation patch 831 to generate the resonance of 28 GHz. The first slot 821 and the second slot 823 can conduct coupling with the second radiation patch 833 to allow the second radiation patch 833 to generate the resonance of 39 GHz, thereby realizing the full frequency coverage of the antenna module.

According to rules of 3GPP 38. 101 Agreement, 5G NR mainly uses two frequency bands: FR1 frequency band and FR2 frequency band. The frequency range of FR1 frequency band is 450 MHz-6 GHz, which is usually called sub 6 GHz. The frequency range of FR2 frequency band is 4.25 GHz-52.6 GHz, which is usually called millimeter wave (mm Wave). The 3GPP specifies the frequency bands of 5G millimeter wave as follows: n257 (26.5-29.5 GHz), n258 (24.25-27.5 GHz), n261 (27.5-28.35 GHz) and n260 (37-40 GHz).

In the present embodiment, the stacked patch antenna 830 is integrated to the non-metallic rear cover 113 (such as a 3D glass rear cover, a ceramic rear cover, and so on) with the high dielectric constant, which directly reduces a coverage problem caused by the non-metallic rear cover 113 and maintains a high gain in a full frequency band of the millimeter wave specified by 3GPP. Moreover, the stacked patch antenna 830 is fed by means of coupling through two slots having orthogonal polarization directions, such that an impedance bandwidth of the antenna module can cover the full frequency band of the millimeter wave specified by 3GPP, thus realizing an antenna radiation of a full frequency band, a double polarization, a high efficiency and a high gain.

In an embodiment, the feeding layer 810 includes a feeding substrate 811, a first feeding unit 813 and a second feeding unit 815 arranged on the feeding substrate 811. The first feeding unit 813 and the second feeding unit 815 have different feed polarization directions. The feeding substrate 811 includes a first surface and a second surface facing away from each other. It should be noted that the first surface is a surface facing away from the ground layer 880 and the second surface is a surface facing towards the ground layer 880. The first feeding unit 813 and the second feeding unit 815 are both arranged to the first surface.

In an embodiment, the first feeding unit 813 and the second feeding unit 815 both include a feeding route. The first feeding unit 813 may be understood as a vertical polarization feeding route, and the second feeding unit 815 may be understood as a horizontal polarization feeding route. In some embodiments, the first feeding unit 813 may also be understood as a horizontal polarization feeding route, and the second feeding unit 815 may be understood as a vertical polarization feeding route.

A routing direction of the feeding unit is an extending direction of the feeding route. In some embodiments, the feeding route is a strip line, whose impedance is easy to control and whose shielding is good, thus effectively reducing a loss of electromagnetic energy and improving the efficiency of the antenna.

In an embodiment, the first slot 821 is separated from the second slot 823. The first slot 821 is arranged corresponding to the first feeding unit 813, and the second slot 823 is arranged corresponding to the second feeding unit 815. In some embodiments, an orthogonal projection area of the first feeding unit 813 on the ground layer 880 may completely cover an area where the first slot 821 is, and an orthogonal projection area of the second feeding unit 815 on the ground layer 880 may completely cover an area where the second slot 823 is.

An extending direction of the first slot 821 is perpendicular to an extending direction of the second slot 823. That is, a polarization direction of the first slot 821 and a polarization direction of the second slot 823 are perpendicular to each other. For example, when the first slot 821 is a vertical polarization slot, the second slot 823 is a horizontal polarization slot; or, when the first slot 821 is a horizontal polarization slot, the second slot 823 is a vertical polarization slot.

It should be noted that the extending direction of each of the first slot 821 and the second slot 823 may be understood as a direction along a long edge of the slot, and the polarization direction of each of the first slot 821 and the second slot 823 may be understood as a direction along a narrow edge of the slot.

In an embodiment, the extending direction of the first slot 821 is arranged perpendicular to the routing direction of the first feeding unit 813, and the extending direction of the second slot 823 is arranged perpendicular to the routing direction of the second feeding unit 815. That is, the polarization direction of the first slot 821 is the same with that of the first feeding unit 813, and the polarization direction of the second slot 823 is the same with that of the second feeding unit 815. For example, when the first slot 821 is the vertical polarization slot, the first feeding unit 813 is the vertical polarization feeding route, the second slot 823 is the horizontal polarization slot, and the second feeding unit 815 is the horizontal polarization feeding route.

In an embodiment, the first radiation patch 831 is attached to a side of the rear cover 113 facing away from the ground layer 880, and the second radiation patch 833 is attached to a side of the rear cover 113 facing towards the ground layer 880. In some embodiments, the rear cover 113 includes a third surface and a fourth surface facing away from each other. The first radiation patch 831 is attached to the third surface of the rear cover 113, and the second radiation patch 833 is attached to the fourth surface of the rear cover 113. Geometric centers of the first radiation patch 831 and the second radiation patch 833 are symmetrically arranged with respect to a plane where the rear cover 113 is.

In some embodiments, an orthogonal projection of the first radiation patch 831 on the ground layer 880 may cover at least part of the first slot 821 and/or at least part of the second slot 823, and an orthogonal projection of the second radiation patch 833 on the ground layer 880 may cover at least part of the first slot 821 and/or at least part of the second slot 823.

In an embodiment, the first radiation patch 831 is a loop patch antenna, such as a square loop patch or a round loop patch. The second radiation patch 833 is one of a square patch, a round patch, a loop patch and a cross patch. In the present embodiment, when the first radiation patch 831 is the loop patch antenna, the effective radiance of the second radiation patch 833 can be increased.

The geometric centers of the first radiation patch 831 and the second radiation patch 833 are located in an axis perpendicular to the plane where the rear cover 113 is. That is, the geometric centers of the first radiation patch 831 and the second radiation patch 833 are symmetrically arranged with respect to the plane where the rear cover 113 is. In an embodiment, when the first radiation patch 841 is the loop patch antenna, an outline of the first radiation patch 841 is the same with an outline of the second radiation patch 843. For example, the first radiation patch 841 is the round loop patch, and the second radiation patch 843 is the round patch; or, the first radiation patch 841 is the square loop patch, and the second radiation patch 843 is the square patch, and so on.

In an embodiment, the materials of the first radiation patch 831 and the second radiation patch 833 may be metal materials, transparent conductive materials with a high conductivity (such as indium tin oxide, silver nanowire, ITO materials, graphene, and so on).

In an embodiment, the rear cover 113 of the electronic device is a glass rear cover 113. The materials of both the first radiation patch 831 and the second radiation patch 833 are transparent materials. Both the first radiation patch 831 and the second radiation patch 833 are integrated in different surfaces of the glass rear cover 113. The first radiation patch 831 and the second radiation patch 833 are made of transparent antenna materials, and have a high light-wave-band transmittance. However, in a microwave band, such as the millimeter wave band, the first radiation patch 831 and the second radiation patch 833 are similar to a metal antenna, and have a high conductivity.

In an embodiment, both the first slot 821 and the second slot 823 are rectangular slots, and the extending direction of the first slot 821 is arranged perpendicular to that of the second slot 823. The extending direction may be understood as a direction (L) along a long edge of the rectangular slot, and the polarization direction of each of the first slot 821 and the second slot 823 may be understood as a direction (W) along a narrow edge of the rectangular slot. The routing direction of the first feeding unit 813 is perpendicular to the extending direction of the first slot 821, and the routing direction of the second feeding unit 815 is perpendicular to the extending direction of the second slot 823.

In an embodiment, at least part of the first slot 821 is orthogonally projected on an area of the first radiation patch 831 or an area of the second radiation patch 833, and at least part of the second slot 823 is orthogonally projected on the area of the first radiation patch 831 or the area of the second radiation patch 833.

In an embodiment, the first slot 821 has the same shape as the second slot 823. Taking the first slot 821 as an example, the first slot 821 includes a first part, a second part and a third part. The second part and the third part are communicated with the first part, respectively. The second part and the third part are arranged in parallel, and the first part is arranged perpendicular to the second part and the third part, respectively. All the first part, the second part and the third part are linear slots. That is, the first slot 821 and the second slot 823 are both "H"-shaped slots. The extending direction of the first slot 821 and the extending direction of the second slot 823 may be understood as an extending direction of the first part, that is, a direction perpendicular to the second part or the third part. The routing directions of the first feeding unit and the second feeding unit are perpendicular to the first part of the "H"-shaped slot.

In an embodiment, the rear cover 113 is a glass rear cover 113 (such as, GG5 glass), and has a dielectric constant (DK) of 7.1, a loss factor (Df, also known as a dielectric loss factor, a tangent of a dielectric loss angle, tan δ) of 0.02, and a thickness of 0.55 mm. The support layer is a foam layer, and has a thickness of 0.45 mm, a dielectric constant DK of 1.9, and a loss factor Df of 0.02. The first radiation patch 231 is a square loop structure having an outer edge length of 1.3 mm and an inner edge length of 1.1 mm. The second radiation patch 233 is a square patch having an edge length of 1.3 mm. Structural dimensions of the first slot 221 and the second slot 223 in the ground layer 220 are the same, and both the first slot 221 and the second slot 223 are rectangular slots having a length of 2.75 mm and a width of 0.16 mm.

Figure 9:
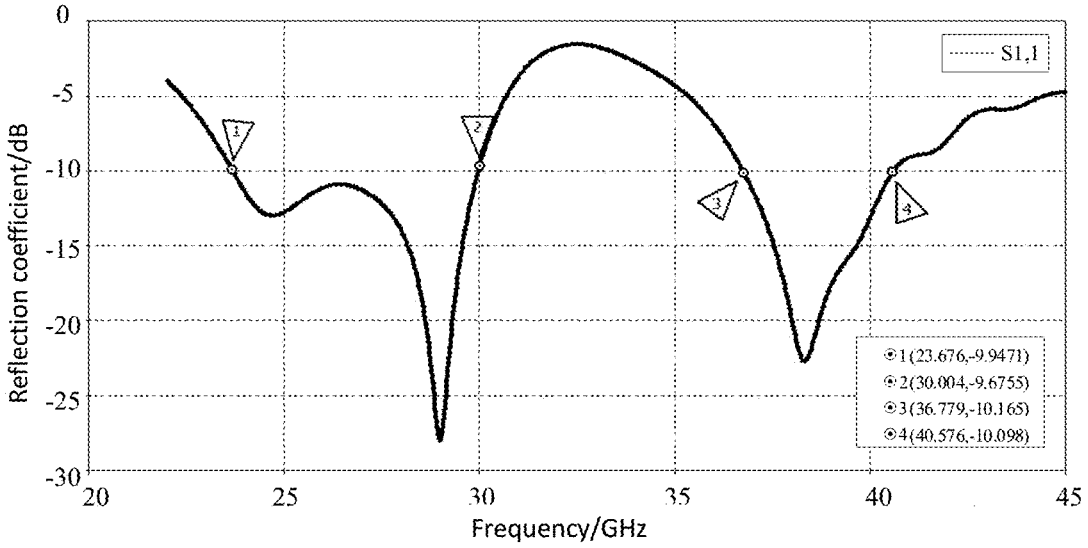
FIG. 9 is a diagram of a reflection coefficient of an antenna module in an embodiment.
Figure 10A:
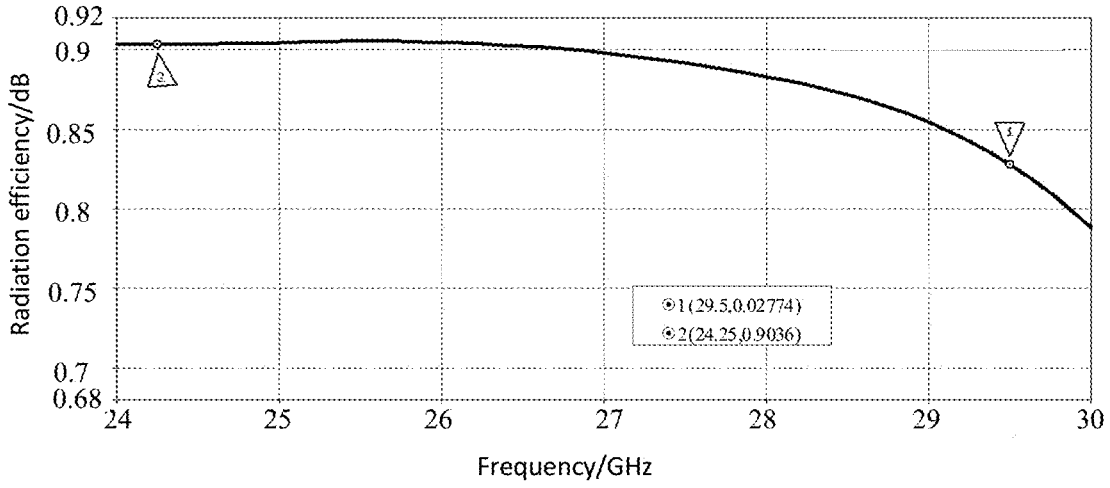
FIG. 10A is diagram of an antenna efficiency of an antenna module in a 28 GHz frequency band in an embodiment.
Figure 10B:
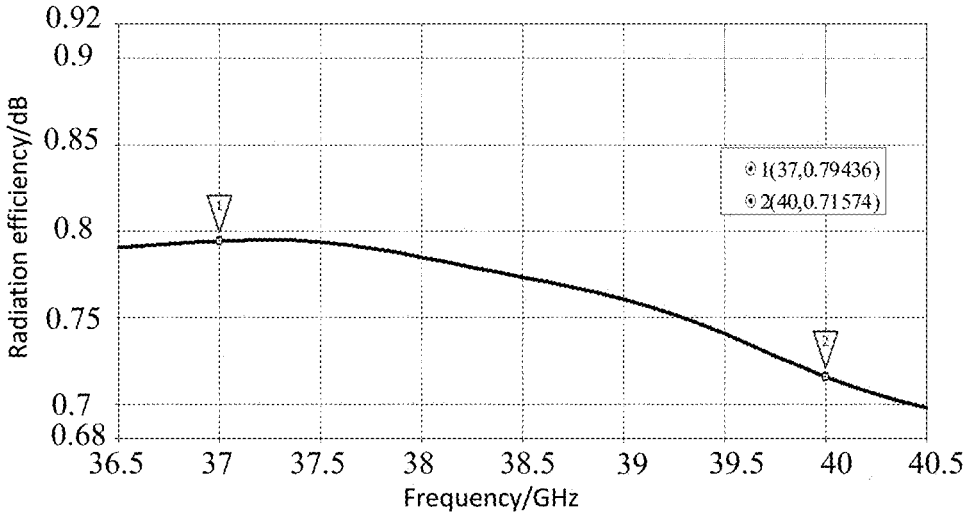
FIG. 10B is a diagram of an antenna efficiency of an antenna module in a 39 GHz frequency band in an embodiment.
Figure 11A:
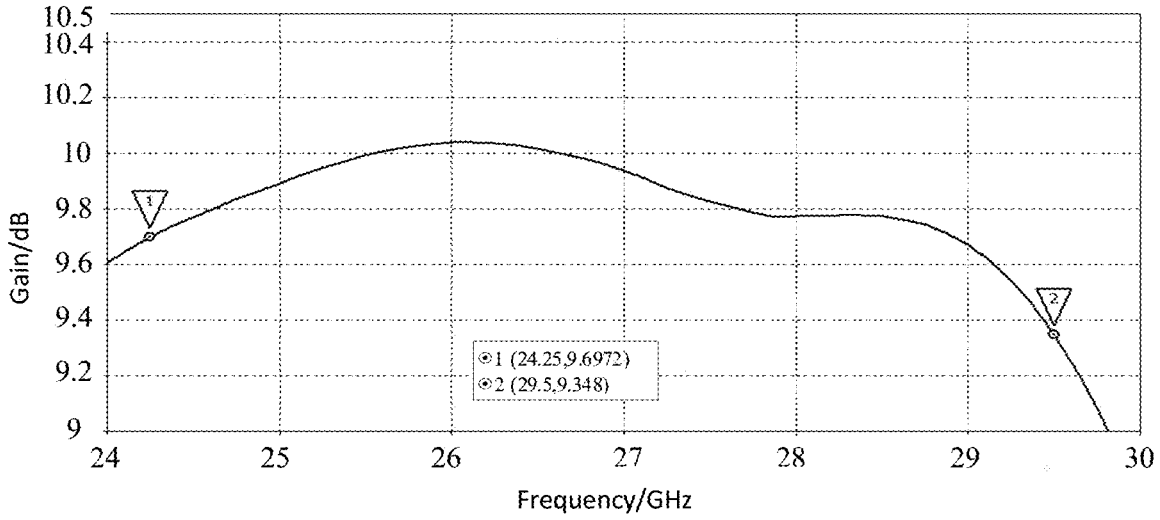
FIG. 11A is a diagram of an antenna gain of an antenna module with 0° phrase shift in a 28 GHz frequency band under an X polarization in an embodiment.
Figure 11B:
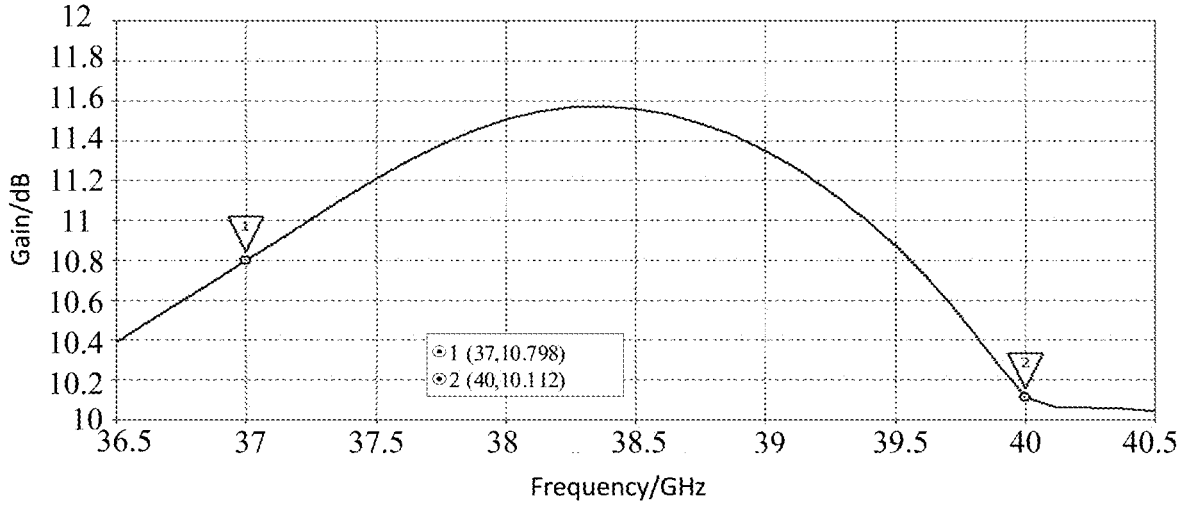
FIG. 11B is a diagram of an antenna gain of an antenna module with 0° phrase shift in a 39 GHz frequency band under an X polarization in an embodiment.
Figure 11C:
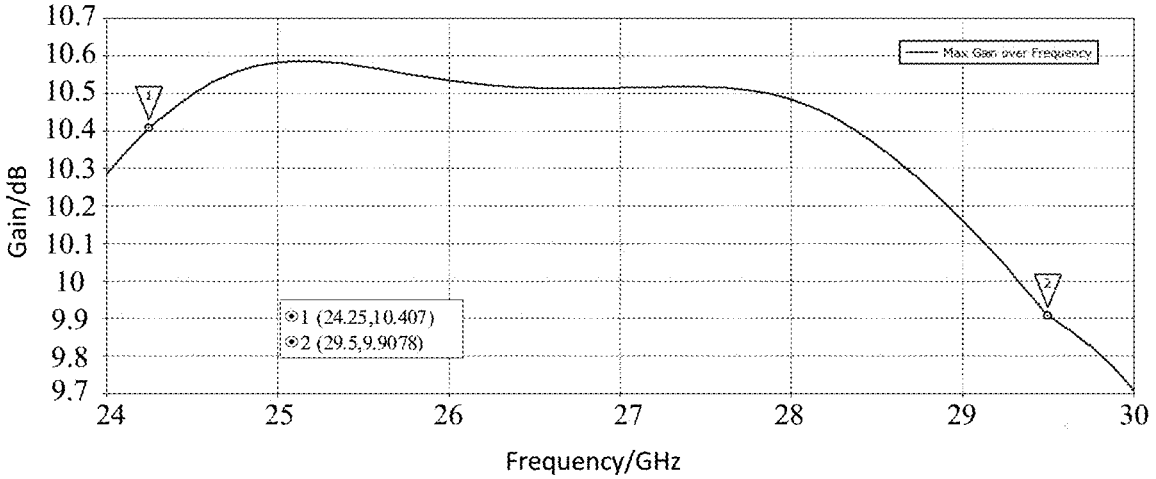
FIG. 11C is a diagram of an antenna gain of an antenna module with 0° phrase shift in a 28 GHz frequency band under a Y polarization in an embodiment.
Figure 11D:
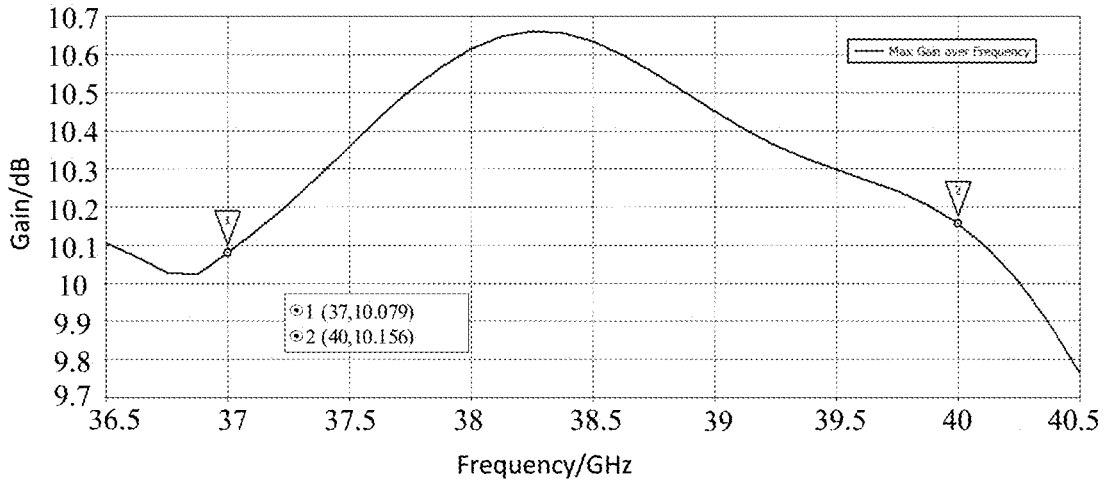
FIG. 11D is a diagram of an antenna gain of an antenna module with 0° phrase shift in a 39 GHz frequency band under a Y polarization in an embodiment.
Figure 12A:
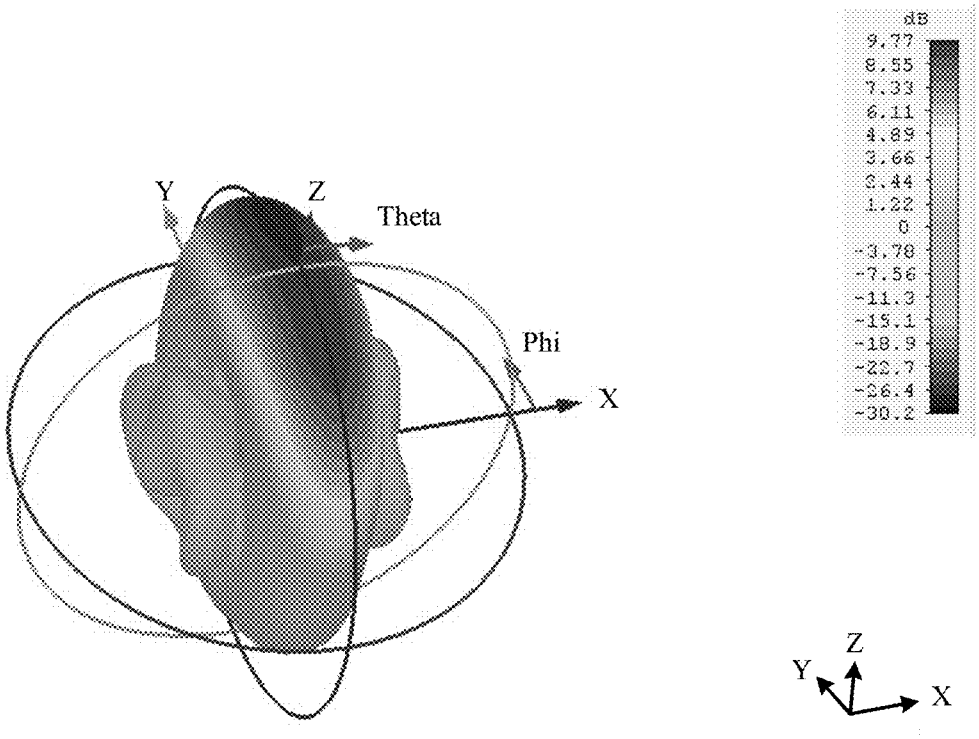
FIG. 12A is an antenna pattern of an antenna module in a 28 GHz frequency band and in a 0° direction under an X polarization in an embodiment.
Figure 12B:
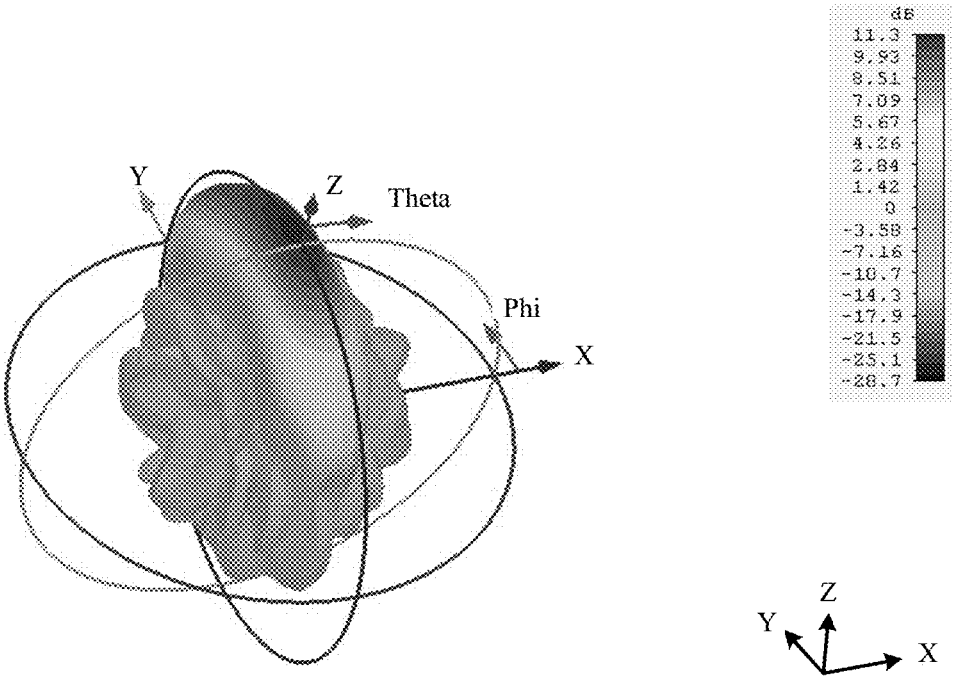
FIG. 12B is an antenna pattern of an antenna module in a 39 GHz frequency band and in a 0° direction under an X polarization in an embodiment.
Figure 12C:
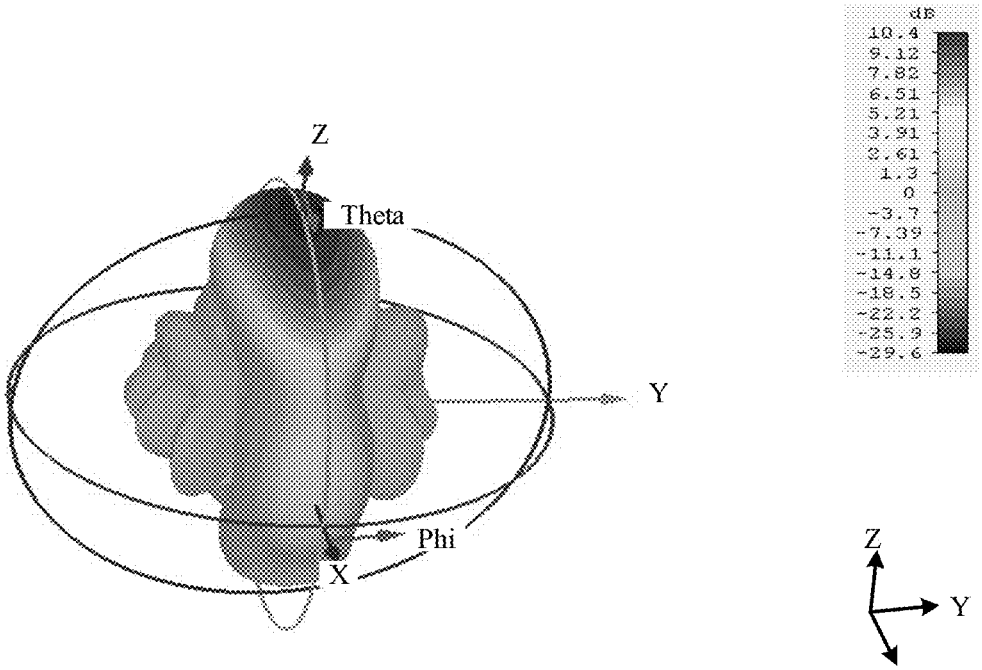
FIG. 12C is an antenna pattern of an antenna module in a 28 GHz frequency band and in a 0° direction under a Y polarization in an embodiment.
Figure 12D:
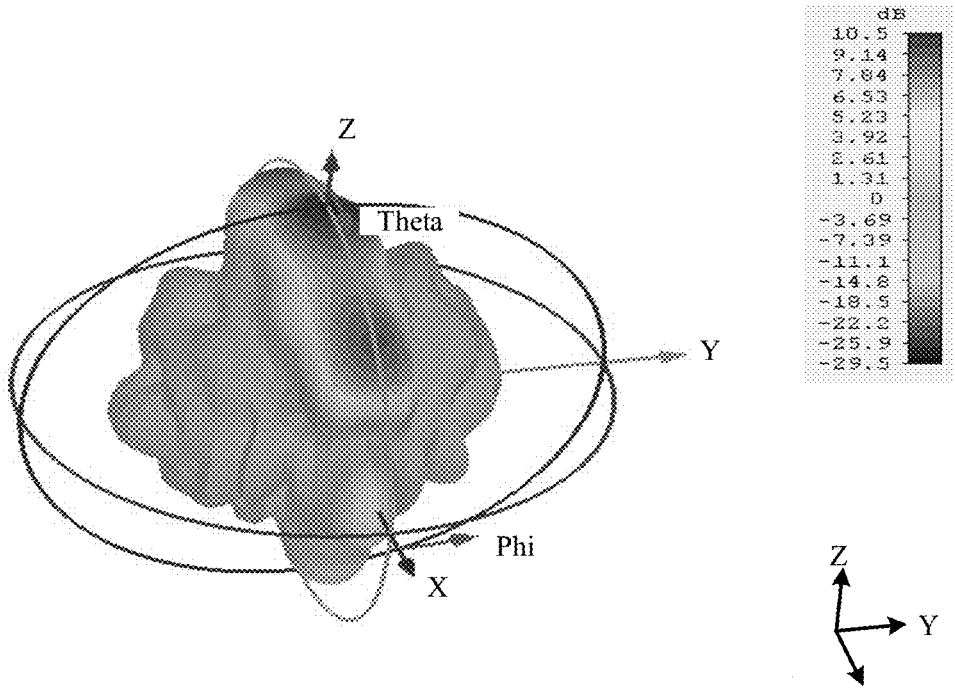
FIG. 12D is an antenna pattern of an antenna module in a 39 GHz frequency band and in a 0° direction under a Y polarization in an embodiment.

FIG. 9 is a diagram of a reflection coefficient of the antenna module in an embodiment. As illustrated in FIG. 9, when an impedance bandwidth S11 is less than or equal to 10 dB, a working frequency band of the antenna module may cover the full frequency band (24.25-29.5 GHz, 37-40 GHz) of the millimeter wave specified by 3GPP. FIG. 10A is a diagram of an antenna efficiency of the antenna module in a 28 GHz frequency band in an embodiment, and FIG. 10B is a diagram of an antenna efficiency of the antenna module in a 39 GHz frequency band in an embodiment. As illustrated in FIG. 10A and FIG. 10B, the radiation efficiency of the antenna is more than 80% in the 28 GHz frequency band (24.25-29.5 GHz) and more than 70% in the 39 GHz frequency band (37-40 GHz). FIG. 11A is a diagram of an antenna gain of the antenna module with 0° phrase shift in the 28 GHz frequency band under an X polarization in an embodiment. FIG. 11B is a diagram of an antenna gain of the antenna module with 0° phrase shift in the 39 GHz frequency band under an X polarization in an embodiment. As illustrated in FIG.11A and FIG. 11B, under the X polarization feeding, the antenna gain keeps above 9.3 dB in the 28 GHz frequency band (24.25-29.5 GHz) and above 10.1 dB in the 39 GHz frequency band (37-40 GHz), while under a Y polarization feeding, the antenna gain keeps above 9.9 dB in the 28 GHz frequency band (24.25-29.5 GHz) and above 10 dB in the 39 GHz frequency band (37-40 GHz), thus satisfying the 3GPP performance index.

FIG. 12 is an antenna pattern of the antenna module in 28 GHz and 39 GHz frequency points in an embodiment. FIG. 12(*a*) illustrates an antenna pattern at 28 GHz and in a 0° direction, FIG. 12(*b*) illustrates an antenna pattern at 28 GHz and in a 45° scanning direction, and FIG. 12(*c*) illustrates an antenna pattern at 39 GHz and in the 0° direction. As can be seen from FIG. 12(*a*) and FIG. 12(*b*), the antenna module has a high gain and a phase scanning function. The electronic device in the embodiment may integrate the stacked patch antenna 830 into the non-metallic rear cover 113 (such as a 3D glass rear cover, a ceramic rear cover, and so on) with the high dielectric constant, which directly reduces a coverage problem caused by the non-metallic rear cover 113 and maintains the high gain in the full frequency band of the millimeter wave specified by 3GPP. Moreover, the stacked patch antenna 830 is fed by means of coupling through two slots having orthogonal polarization directions, such that the impedance bandwidth (S11≤−10 dB) of the antenna module covers the full frequency band of the millimeter wave specified by 3GPP. Furthermore, the radiation efficiency of the antenna module is more than 80% in the 28 GHz frequency band (24.25-29.5 GHz) and more than 70% in the 39 GHz frequency band (37-40 GHz), thereby realizing an antenna radiation of a full frequency band, a double polarization, a high efficiency and a high gain.

The electronic device may include a mobile phone, a tablet computer, a notebook computer, a palmtop computer, a mobile internet device (MID), a wearable device (such as a smart watch, a smart bracelet, a pedometer, and so on) or other communication modules provided with an antenna.

Figure 13:
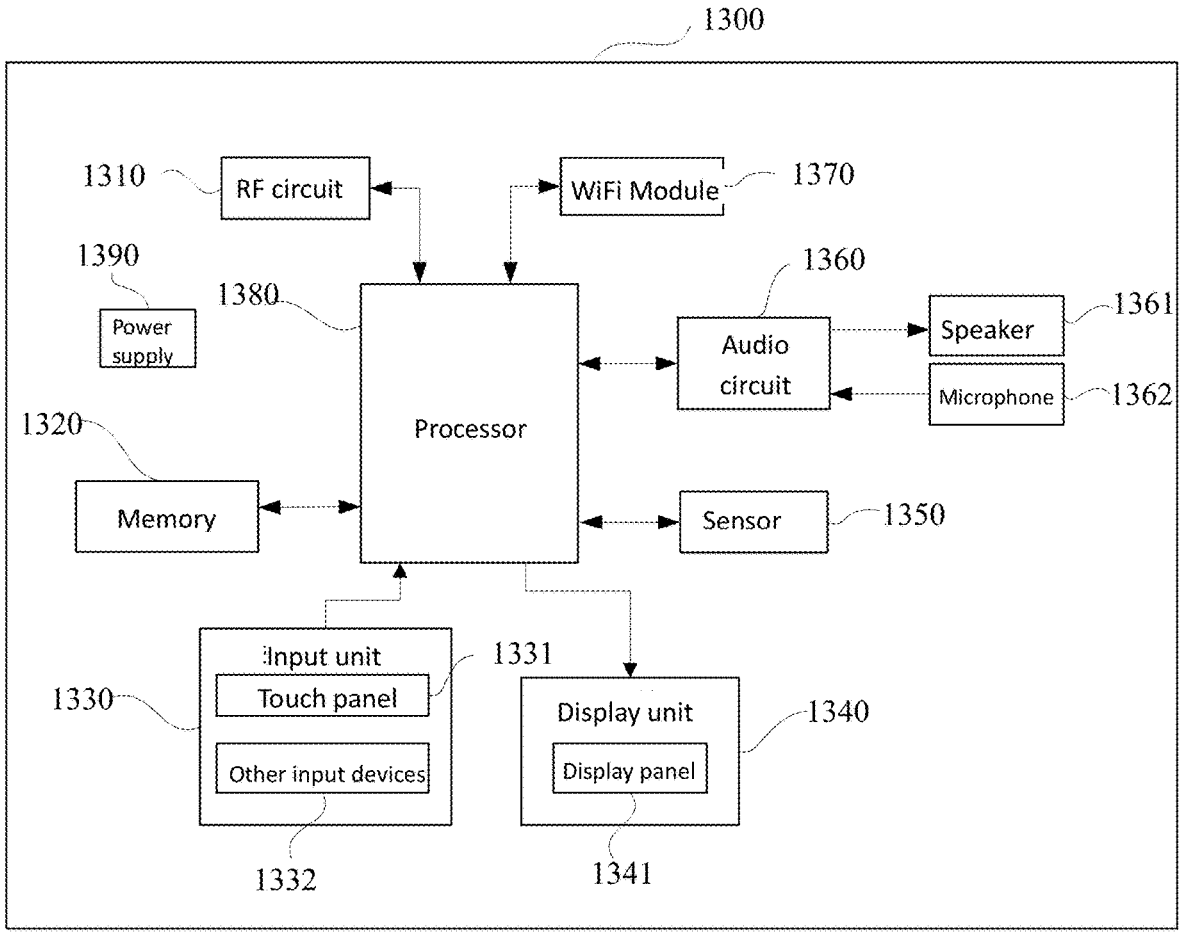
FIG. 13 is a block diagram of a partial structure of a mobile phone related to an electronic device provided by an embodiment of the present disclosure.

FIG. 13 is a block diagram of a partial structure of a mobile phone related to an electronic device provided by an embodiment of the present disclosure. As illustrated in FIG. 13, the mobile phone 1300 includes: an array antenna 1310, a memory 1320, an input unit 1330, a display unit 1340, a sensor 1350, an audio circuit 1360, a wireless fidelity (WIFI) module 1370, a processor 1380, a power supply 1390 and other components. It should be understood by those skilled in related art that the structure of the mobile phone illustrated in FIG. 13 is not construed to limit the mobile phone, and may include more or less components than the components illustrated, or combine some components, or have different component arrangements.

The array antenna 1310 may be used for receiving and transmitting signals in the process of receiving and transmitting information or calling. After receiving a downlink information of a base station, the array antenna 1310 may transmit the information to the processor 1380, or, the array antenna 1310 may transmit an uplink data to the base station. The memory 1320 may be used to store software programs and modules, and the processor 1380 may perform various function applications and data processing of the mobile phone by running the software programs and modules stored in the memory 1320. The memory 1320 may mainly include a program memory area and a data memory area. The program memory area may store an operating system, an application program required for at least one function (such as an application program for sound playing function, an application program for image playing function). The data memory area may store data (such as audio data, address book, and so on) created according to the use of the mobile phone, and so on. In addition, the memory 1320 may include a high-speed random access memory and also a non-volatile memory, such as at least one disk memory member, a flash memory member, or other volatile solid memory members.

The input unit 1330 may be used to receive input digital or character information, and generate a key signal input related to the user setting and the function control of the mobile phone 1300. In an embodiment, the input unit 1330 may include a touch panel 1331 and other input devices 1332. The touch panel 1331 also known as a touch screen, may collect user's touch operations on or near it (such as user's operations on or near the touch panel 1331 with any suitable object or accessory such as a finger, a touch pen), and drive a corresponding connection device according to a preset program. In an embodiment, the touch panel 1331 may include two parts: a touch measuring device and a touch controller. The touch measuring device measures a touch orientation of the user, measures a signal brought by the touch operation, and transmits the signal to the touch controller. The touch controller receives touch information from the touch measuring device, converts it into a contact coordinate, then sends it to the processor 1380, and receives and executes a command sent by the processor 1380. In addition, various kinds of touch panels 1331 may be realized, such as a resistance touch panel, a capacitance touch panel, an infrared touch panel and a surface-acoustic-wave touch panel. Besides the touch panel 1331, the input unit 1330 may further include other input devices 1332. In an embodiment, the other input devices 1332 may include, but are not limited to, one or more of a physical keyboard, and a function key (such as a volume control key, a switch key, and so on).

The display unit 1340 may be used to display information that is input by the user or provided to the user and various menus of the mobile phone. The display unit 1340 may include a display panel 1341. In an embodiment, the display panel 1341 may be configured in a form of a liquid crystal display (LCD), an organic light-emitting diode (OLED), and so on. In an embodiment, the touch panel 1331 may cover the display panel 1341. When the touch panel 1331 measures a touch operation on or near it, the touch operation is transmitted to the processor 1380 to determine a type of the touch operation. Then, the processor 1380 provides a corresponding visual output on the display panel 1341 according to the type of touch operation. Although in FIG. 13, the touch panel 1331 and the display panel 1341 serve as two independent components to realize the input and input functions of the mobile phone, the touch panel 1331 and the display panel 1341 may be integrated to realize the input and output functions of the mobile phone in some embodiments.

The mobile phone 1300 may further include at least one sensor 1350, such as an optical sensor, a motion sensor, and other sensors. In an embodiment, the light sensor may include an ambient light sensor and a proximity sensor. The ambient light sensor may adjust a brightness of the display panel 1341 according to the light and shade of an ambient light, and the proximity sensor may turn off the display panel 1341 and/or the backlight when the mobile phone moves to an ear. The motion sensor may include an acceleration sensor, which may measure accelerations in all directions. When the motion sensor stays still, it may measure a magnitude and a direction of gravity, which may be used to applications identifying a mobile phone posture (such as a horizontal and vertical screen switching), and functions related to vibration identification (such as a pedometer, a percussion), and so on. In addition, the mobile phone may be provided with a gyroscope, a barometer, a hygrometer, a thermometer, an infrared sensor and other sensors.

An audio circuit 1360, a speaker 1361 and a microphone 1362 may provide an audio interface between the user and the mobile phone. The audio circuit 1360 may transmit an electrical signal converted by the received audio data to the speaker 1361, and the speaker 1361 converts the electrical signal to a sound signal to be output. On the other hand, the microphone 1362 converts a collected audio signal into an electrical signal, the audio circuit 1360 receives the electrical signal and converts the electrical signal into audio data, and the audio data is output to the processor 1380 to be processed. Then, the processed audio date is sent to another mobile phone by the array antenna 1310, or output to the memory 1320 for subsequent processing.

The processor 1380 is a control center of the mobile phone, which uses various interfaces and lines to connect all parts of the mobile phone, and performs various functions of the mobile phone and processes data by running or executing software programs and/or modules stored in the memory 1320 and invoking data stored in the memory 1320, so as to monitor the overall mobile phone. In an embodiment, the processor 1380 may include one or more processing units. In an embodiment, the processor 1380 may integrate an application processor and a modulating-demodulating processor. The application processor mainly processes an operating system, a user interface, an application program, and so on. The modulating-demodulating processor mainly processes a wireless communication. It should be understood that the above modulating-demodulating processor may not be integrated into the processor 1380.

The mobile phone 1300 further includes a power supply 1390 (such as a battery) for supplying power to each component. In some embodiments, the power supply may be logically connected to the processor 1380 through a power management system, so as to realize functions of charging, discharging, and power consumption management through the power management system.

In an embodiment, the mobile phone 1300 may further include a camera, a bluetooth module, and so on.

Any reference to a memory, a storage, a database or other media used in the present disclosure may include a non-volatile and/or volatile memory. A suitable non-volatile memory may include a read-only memory (ROM), a programmable ROM (PROM), an electrically programmable ROM (EPROM), an electrically erasable programmable ROM (EEPROM), or a flash memory. The volatile memory may include a random access memory (RAM), which is used as an external cache memory. The RAM may be obtained in many forms, such as static random access memory (SRAM), a dynamic random access memory (DRAM), a synchronous dynamic random access memory (SDRAM), a double data rate synchronous dynamic random access memory (DDR SDRAM), an enhanced synchronous dynamic random access memory (ESDRAM), a synchlink dynamic random access memory (SLDRAM), a rambus direct random access memory (RDRAM), a direct rambus dynamic random access memory (DRDRAM), and a rambus dynamic random access memory (RDRAM).

Respective technical features of the above embodiments may be combined arbitrarily. In order to make the description concise, all possible combinations of the respective technical features in the above embodiments are not described. However, as long as the combinations of these technical features do not have contradictions, they should be considered to be fallen into the scope of the description.

The above embodiments only express several embodiments of the present disclosure, and the descriptions thereof are specific and detailed, which thus cannot be construed as a limitation of the protection scope of the present disclosure. It should be noted that for those skilled in the related art, several modifications and improvements can be made without departing from the principle of the present disclosure, which belong to the protection scope of the present disclosure. Therefore, the protection scope of the patent disclosure shall be subject to the appended claims.

What is claimed is:

1. An antenna module, comprising:

a feeding layer;

a ground layer arranged on the feeding layer, and provided with a first slot and a second slot, the first slot and the second slot being separated and having orthogonal polarization directions;

a dielectric base plate arranged on the ground layer; and a stacked patch antenna comprising a first radiation patch and a second radiation patch, the first radiation patch and the second radiation patch being arranged on two sides of the dielectric base plate facing away from each other, the first radiation patch being aligned with the second radiation patch, an orthogonal projection of the first radiation patch on the ground layer covering at least one of at least part of the first slot and at least part of the second slot, and an orthogonal projection of the second radiation patch on the ground layer covering at least one of at least part of the first slot and at least part of the second slot, wherein the feeding layer is configured to feed the stacked patch antenna through the first slot and the second slot, the first radiation patch is configured to generate a resonance in a first frequency band under the feeding of the feeding layer and the second radiation patch is configured to generate a resonance in a second frequency band under the feeding of the feeding layer, and wherein the first radiation patch and the second radiation patch are configured to generate a resonance in a third frequency band by coupling with the first slot and the second slot.

2. The antenna module according to claim 1, wherein the stacked patch antenna generates the resonance in the third frequency band by adjusting sizes of the first slot and the second slot.

3. The antenna module according to claim 1, wherein the first radiation patch is attached to a side of the dielectric base plate facing away from the ground layer, and the second radiation patch is attached to a side of the dielectric base plate facing towards the ground layer.

4. The antenna module according to claim 1, wherein the feeding layer comprises a first feeding unit and a second feeding unit having different routing directions, an orthogonal projection of the first feeding unit on the ground layer covers the first slot, and an orthogonal projection of the second feeding unit on the ground layer covers the second slot, wherein an extending direction of the first slot is perpendicular to the routing direction of the first feeding unit, and an extending direction of the second slot is perpendicular to the routing direction of the second feeding unit.

5. The antenna module according to claim 4, wherein both the first slot and the second slot are rectangular slots, and the extending direction of the first slot is arranged perpendicular to the extending direction of the second slot.

6. The antenna module according to claim 4, wherein the first slot has a same shape as the second slot, the first slot comprises a first part, a second part and a third part, the second part and the third part are communicated with the first part, respectively, the second part and the third part are arranged in parallel, and the first part is arranged perpendicular to the second part and the third part, respectively, in which the extending direction of the first slot is configured as an extending direction of the first part, the routing direction of the first feeding unit is arranged perpendicular to the extending direction of the first slot, and the routing direction of the second feeding unit is arranged perpendicular to the extending direction of the second slot.

7. The antenna module according to claim 1, wherein centers of the first radiation patch and the second radiation patch are both located in a central axis perpendicular to the dielectric base plate.

8. The antenna module according to claim 7, wherein the first radiation patch is a loop patch antenna, and the second radiation patch is one of a square patch, a round patch, a loop patch and a cross patch.

9. The antenna module according to claim 8, wherein an outline of the first radiation patch is the same with an outline of the second radiation patch.

10. An electronic device, comprising:

a feeding layer;

a ground layer arranged on the feeding layer and provided with a first slot and a second slot, the first slot and the second slot being separated and having orthogonal polarization directions;

a non-metallic rear cover arranged opposite to the ground layer; and a stacked patch antenna comprising a first radiation patch and a second radiation, the first radiation patch and the second radiation patch being arranged on the rear cover and facing away from each other, an orthogonal projection of the first radiation patch on the ground layer covering at least one of at least part of the first slot and at least part of the second slot, and an orthogonal projection of the second radiation patch on the ground layer covering at least one of at least part of the first slot and at least part of the second slot, wherein the feeding layer is configured to feed the stacked patch antenna through the first slot and the second slot, the first radiation patch is configured to generate a resonance in a first frequency band under the feeding of the feeding layer and the second radiation patch is configured to generate a resonance in a second frequency band under the feeding of the feeding layer, and wherein the first radiation patch and the second radiation patch are configured to generate a resonance in a third frequency band by coupling with the first slot and the second slot.

11. The electronic device according to claim 10, wherein the stacked patch antenna generates the resonance in the third frequency band by adjusting sizes of the first slot and the second slot.

12. The electronic device according to claim 10, wherein the first radiation patch is attached to a side of the non-metallic rear cover facing away from the ground layer, and the second radiation patch is attached to a side of the non-metallic rear cover facing towards the ground layer.

13. The electronic device according to claim 12, wherein the non-metallic rear cover is a glass rear cover, materials of both the first radiation patch and the second radiation patch are transparent materials, and the first radiation patch and the second radiation patch are integrated in different surfaces of the glass rear cover.

14. The electronic device according to claim 10, wherein the feeding layer comprises a first feeding unit and a second feeding unit having different routing directions, an orthogonal projection of the first feeding unit on the ground layer covers the first slot, and an orthogonal projection of the second feeding unit on the ground layer covers the second slot, wherein an extending direction of the first slot is perpendicular to the routing direction of the first feeding unit, and an extending direction of the second slot is perpendicular to the routing direction of the second feeding unit.

15. The electronic device according to claim 14, wherein both the first slot and the second slot are rectangular slots, and the extending direction of the first slot is arranged perpendicular to the extending direction of the second slot.

16. The electronic device according to claim 10, wherein centers of the first radiation patch and the second radiation patch are both located in a central axis perpendicular to the rear cover.

17. The electronic device according to claim 16, wherein an outline of the first radiation patch is the same with an outline of the second radiation patch.

18. The electronic device according to claim 10, further comprising a support layer arranged between the non-metallic rear cover and the ground layer.

19. The electronic device according to claim 18, wherein a dielectric constant of the support layer is less than a dielectric constant of the rear cover.

20. An electronic device, comprising:

a rear cover having a first surface and a second surface facing away from each other, the rear cover being made of non-metallic materials;

a ground layer arranged opposite to the first surface of the rear cover, the ground layer having a first slot and a second slot separated from each other, the first slot having a polarization direction orthogonal to a polarization direction of the second slot;

a stacked patch antenna comprising a first radiation patch and a second radiation, the first radiation patch being arranged to the first surface of the rear cover, the second radiation patch being arranged to the second surface of the rear cover, an orthogonal projection of the first radiation patch on the ground layer covering at least one of at least part of the first slot and at least part of the second slot, and an orthogonal projection of the second radiation patch on the ground layer covering at least one of at least part of the first slot and at least part of the second slot; and a feeding layer arranged to a side of the ground layer facing away from the rear cover, and configured to feed the stacked patch antenna through the first slot and the second slot, the first radiation patch being configured to generate a resonance in a first frequency band under the feeding of the feeding layer and the second radiation patch being configured to generate a resonance in a second frequency band under the feeding of the feeding layer, wherein the first radiation patch and the second radiation patch are configured to generate a resonance in a third frequency band by coupling with the first slot and the second slot.

* * * * *